US009702189B2

(12) United States Patent
Chen

(10) Patent No.: US 9,702,189 B2
(45) Date of Patent: Jul. 11, 2017

(54) ENERGY SAVING APPARATUS FOR ELECTRIC ROLLER SHUTTER

(71) Applicant: CALENDAR ENTERPRISES CO., LTD., Chang-Hwa Hsien (TW)

(72) Inventor: Ju-Huai Chen, Chang-Hwa Hsien (TW)

(73) Assignee: Calendar Enterprises Co., Ltd., Chang-Hwa Hsien (TW)

( * ) Notice: Subject to any disclaimer, the term of this patent is extended or adjusted under 35 U.S.C. 154(b) by 0 days.

(21) Appl. No.: 14/986,806

(22) Filed: Jan. 4, 2016

(65) Prior Publication Data

US 2017/0096855 A1 Apr. 6, 2017

(30) Foreign Application Priority Data

Oct. 1, 2015 (JP) ..... 2015-004987

(51) Int. Cl.
*E06B 9/56* (2006.01)
*E06B 9/68* (2006.01)
*E06B 9/72* (2006.01)

(52) U.S. Cl.
CPC ..... *E06B 9/68* (2013.01); *E06B 9/72* (2013.01); *E06B 2009/6809* (2013.01)

(58) Field of Classification Search
CPC ..... E06B 9/74; E06B 9/68; E06B 9/72; E06B 9/70
USPC ..... 160/309, 310, 314
See application file for complete search history.

(56) References Cited

U.S. PATENT DOCUMENTS 1,567,095 A * 12/1925 Anderson ..... E06B 9/90 160/301
1,742,094 A * 12/1929 Perks ..... E04F 10/0614 160/22
1,865,466 A * 7/1932 Gossling ..... E06B 9/90 160/303
5,464,052 A * 11/1995 Wieczorek ..... B60R 5/047 160/23.1
5,793,174 A * 8/1998 Kovach ..... E06B 9/262 318/16

(Continued)

FOREIGN PATENT DOCUMENTS

DE 102012011796 A1 * 12/2013 ..... E06B 9/40
WO WO 2014152427 A1 * 9/2014 ..... E06B 9/322

*Primary Examiner* — Katherine Mitchell
*Assistant Examiner* — Johnnie A Shablack
(74) *Attorney, Agent, or Firm* — Alan D. Kamrath; Kamrath IP Lawfirm, P.A.

(57) ABSTRACT

An energy saving apparatus for an electric roller shutter contains a curtain unit, a fixing unit, a signal receiver, and a controller. The curtain unit includes a driving shaft having a chamber and a rotary connecting portion, and the curtain unit also includes a driver and a curtain. The fixing unit is configured to fix the curtain unit and includes a mounting rack, a first seat, a second seat, and a rolling assembly which reduces power consumption of the driver and facilitates an upward rolling of the curtain, when the curtain rolls. The signal receiver is electrically connected with the driver and includes a casing, a coupling portion, a power supply module, and a receiving module. The controller is configured to send a signal to the receiving module in the casing of the signal receiver, such that the driver of the curtain unit is controlled by the controller to operate.

5 Claims, 8 Drawing Sheets

(56) References Cited

U.S. PATENT DOCUMENTS 5,934,354 A * 8/1999 Price ..... B60R 5/047 160/313
5,990,646 A * 11/1999 Kovach ..... E06B 9/262 318/16
6,116,320 A * 9/2000 Peterson ..... E06B 9/32 160/310
6,131,642 A * 10/2000 Welfonder ..... E06B 9/90 160/301
7,237,592 B2 * 7/2007 Arnoux ..... E06B 9/72 160/192
7,694,712 B2 * 4/2010 Schimko ..... B60J 1/2027 160/314
7,762,306 B2 * 7/2010 Hansen ..... B60R 5/047 160/265
7,874,343 B2 * 1/2011 Hansen ..... B60J 1/2027 160/299
7,931,068 B2 * 4/2011 Carmen, Jr. ..... E06B 9/68 160/120
8,251,120 B2 * 8/2012 Chen ..... E06B 9/42 160/314
8,258,993 B2 * 9/2012 Inoue ..... E06B 9/72 160/310
8,307,879 B2 * 11/2012 Lin ..... E06B 9/40 160/313
8,776,861 B2 * 7/2014 Bohlen ..... E06B 9/62 160/189
8,820,388 B2 * 9/2014 Mullet ..... E06B 9/322 160/310
8,869,870 B2 * 10/2014 Wieczorek ..... B60J 1/2013 160/31
8,947,027 B2 * 2/2015 Mullet ..... H02P 3/08 318/255
9,103,157 B2 * 8/2015 Mullet ..... E06B 9/322
9,394,743 B2 * 7/2016 Mullet ..... E06B 9/40
9,410,369 B2 * 8/2016 Mullet ..... H02P 3/08
2003/0015301 A1 * 1/2003 Killo ..... E06B 9/50 160/310
2006/0086874 A1 * 4/2006 Habel ..... E06B 9/174 248/268
2007/0284053 A1 * 12/2007 Mullet ..... E06B 9/42 160/31
2009/0199975 A1 * 8/2009 Yeh ..... E06B 9/262 160/84.02
2009/0283226 A1 * 11/2009 Cheng ..... E06B 9/60 160/313
2010/0269988 A1 * 10/2010 Mullet ..... E06B 9/62 160/310
2010/0307701 A1 * 12/2010 Peterson ..... E06B 9/72 160/310
2011/0005694 A1 * 1/2011 Ng ..... E06B 9/44 160/311
2013/0220560 A1 * 8/2013 Mullet ..... E06B 9/74 160/291
2014/0069595 A1 * 3/2014 Chen ..... E06B 9/72 160/291
2014/0090787 A1 * 4/2014 Colson ..... E06B 9/82 160/7
2014/0157547 A1 * 6/2014 Chen ..... E06B 9/42 16/400
2014/0224437 A1 * 8/2014 Colson ..... E06B 9/42 160/291
2014/0360684 A1 * 12/2014 Bohlen ..... E06B 9/62 160/310
2014/0360685 A1 * 12/2014 Bohlen ..... E06B 9/62 160/317
2015/0034259 A1 * 2/2015 Bohlen ..... E06B 9/42 160/310
2015/0308186 A1 * 10/2015 Mullet ..... E06B 9/322 160/313
2015/0368968 A1 * 12/2015 Smith ..... E06B 9/50 160/311
2015/0376941 A1 * 12/2015 Fujita ..... E06B 9/26 160/241
2016/0017957 A1 * 1/2016 Graybar ..... E06B 9/322 475/149
2016/0032647 A1 * 2/2016 Adreon ..... E06B 9/322 310/68 B
2016/0138333 A2 * 5/2016 Bohlen ..... E06B 9/62 160/310
2016/0201389 A1 * 7/2016 Oakley ..... E06B 9/322 160/368.1

* cited by examiner

ENERGY SAVING APPARATUS FOR ELECTRIC ROLLER SHUTTER

FIELD OF THE INVENTION

The present innovation relates to an energy saving apparatus for electric roller shutter, and more particularly to an energy saving apparatus for an electric roller shutter which reduces power consumption of a driver and facilitates an upward rolling of a curtain by using a rolling assembly.

BACKGROUND OF THE INVENTION

A conventional curtain is employed to shield sunshine and to adjust lights in a house, and it is rolled upwardly or is unrolled downwardly by pulling a control rope. However, the control rope will wind children's necks if it is used carelessly.

To overcome such a problem, an electric curtain has been developed and contains a track on which an automatic rope roller is mounted to upwardly roll or downwardly unroll the curtain.

In addition, a driving motor is fixed on one end of a top of the electric curtain to drive an upward movement or a downward movement of the electric curtain. Nevertheless, the electric curtain is moved by the driving motor only to cause power consumption.

The present invention has arisen to mitigate and/or obviate the afore-described disadvantages.

SUMMARY OF THE INVENTION

The primary objective of the present innovation is to provide an energy saving apparatus for an electric roller shutter which reduces power consumption of a driver and facilitates an upward rolling of a curtain by using a rolling assembly.

DETAILED DESCRIPTION OF THE PREFERRED EMBODIMENTS

Figure 1:
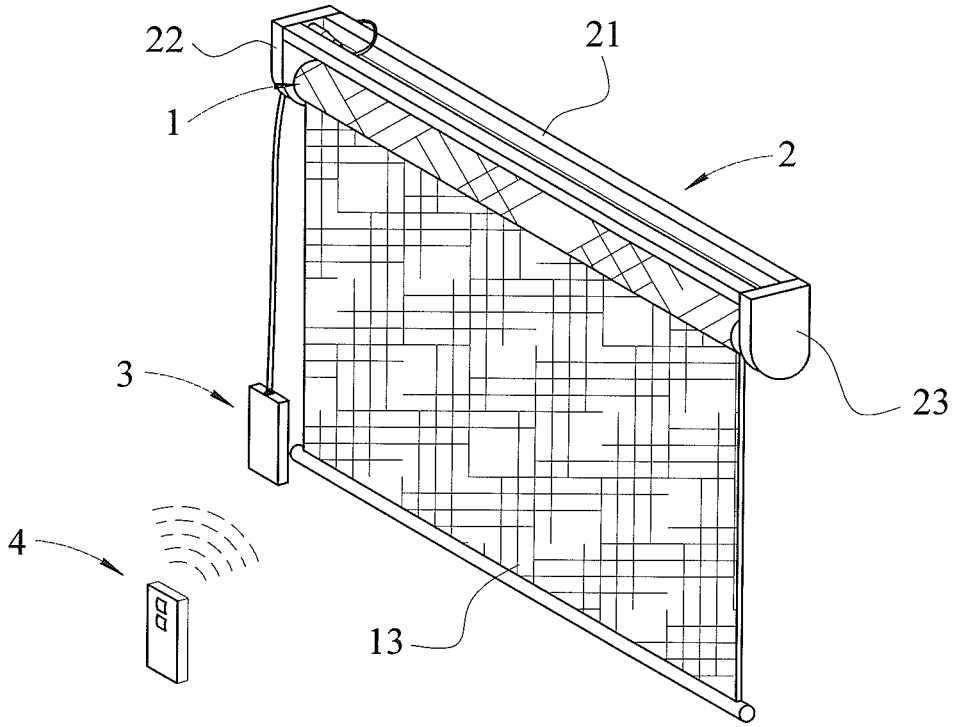
FIG. 1 is a perspective view showing the assembly of an energy saving apparatus for an electric roller shutter in accordance with a preferred embodiment of the present innovation.
Figure 2:
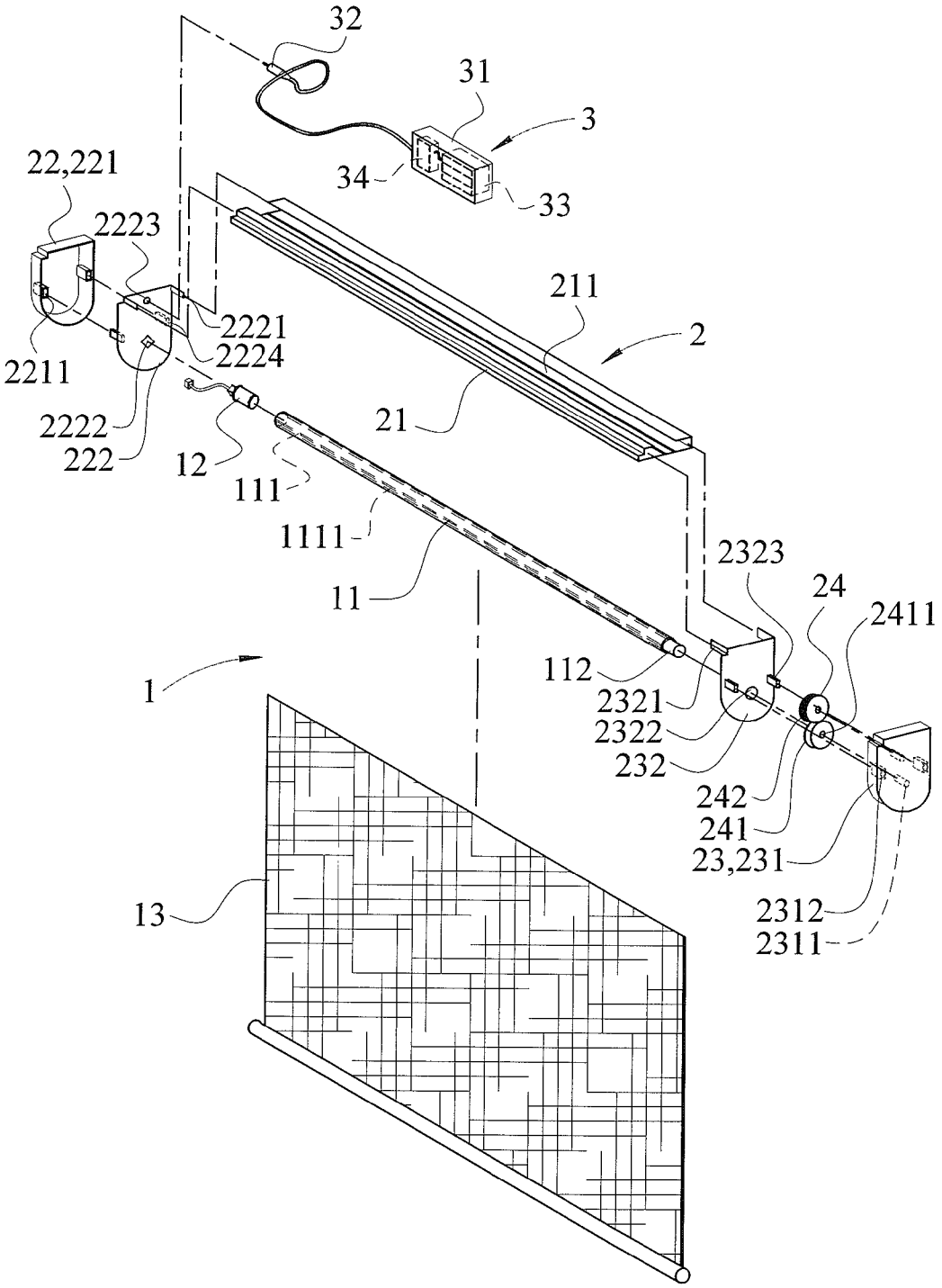
FIG. 2 is a perspective view showing the exploded components of the energy saving apparatus for the electric roller shutter in accordance with the preferred embodiment of the present innovation.
Figure 3:
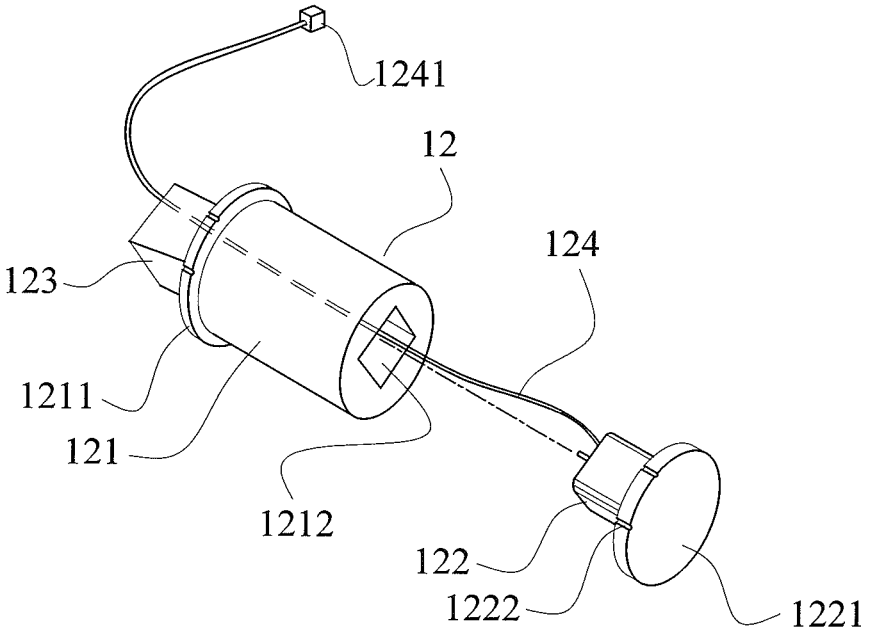
FIG. 3 is a perspective view showing the assembly of a driver of the energy saving apparatus for the electric roller shutter in accordance with the preferred embodiment of the present innovation.
Figure 4:
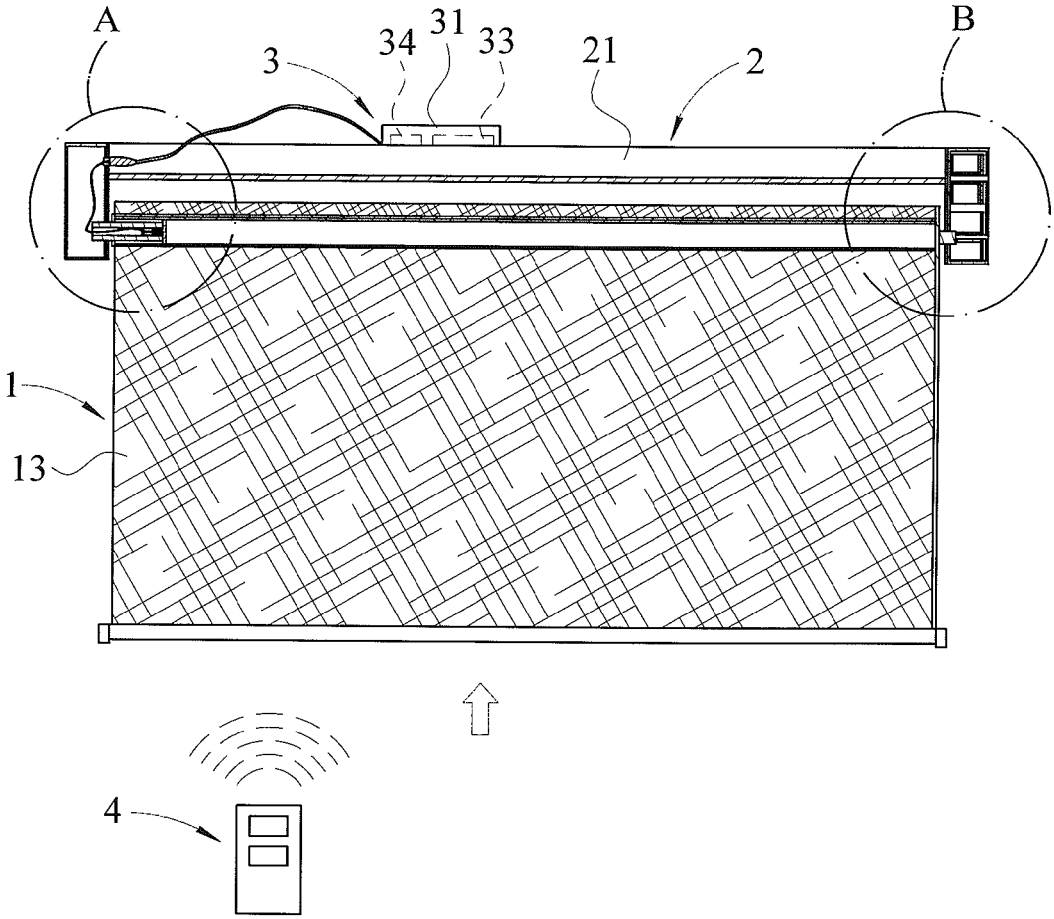
FIG. 4 is a cross sectional view showing the operation of the energy saving apparatus for the electric roller shutter in accordance with the preferred embodiment of the present innovation.
Figure 5:
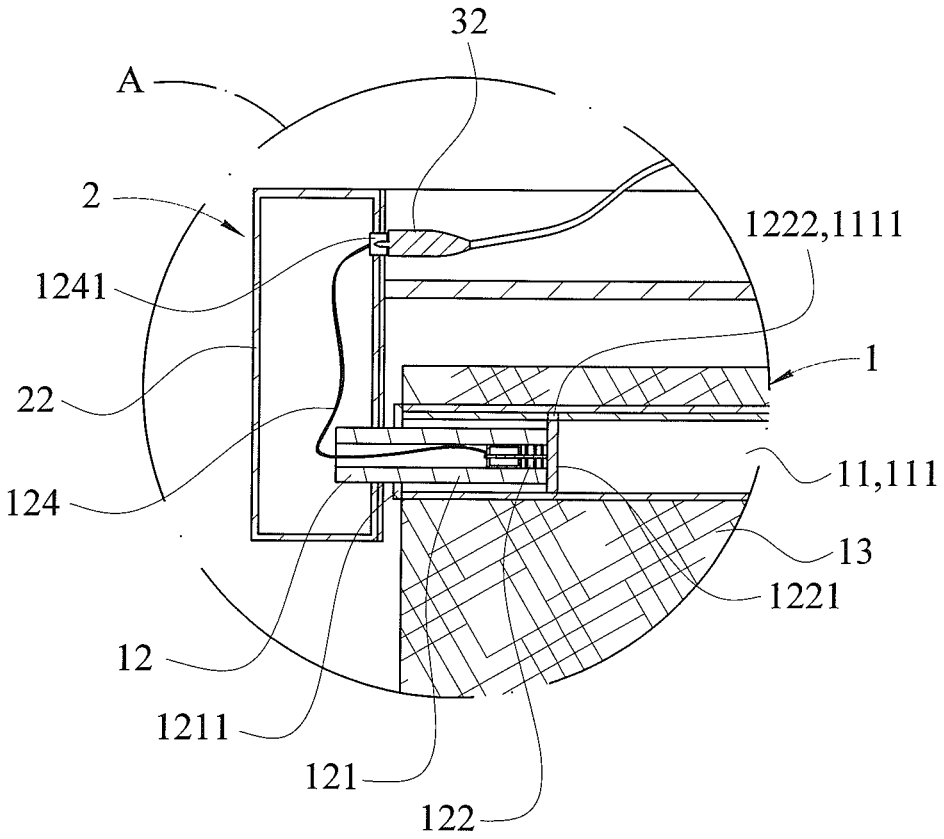
FIG. 5 is an amplified cross sectional view of a portion A of FIG. 4.
Figure 6:
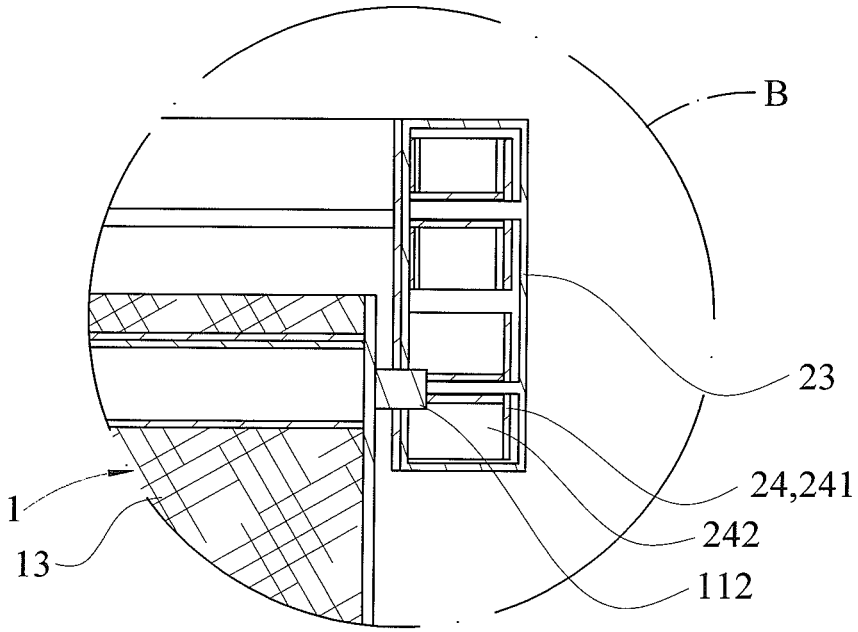
FIG. 6 is an amplified perspective view of a portion B of FIG. 4.
Figure 7:
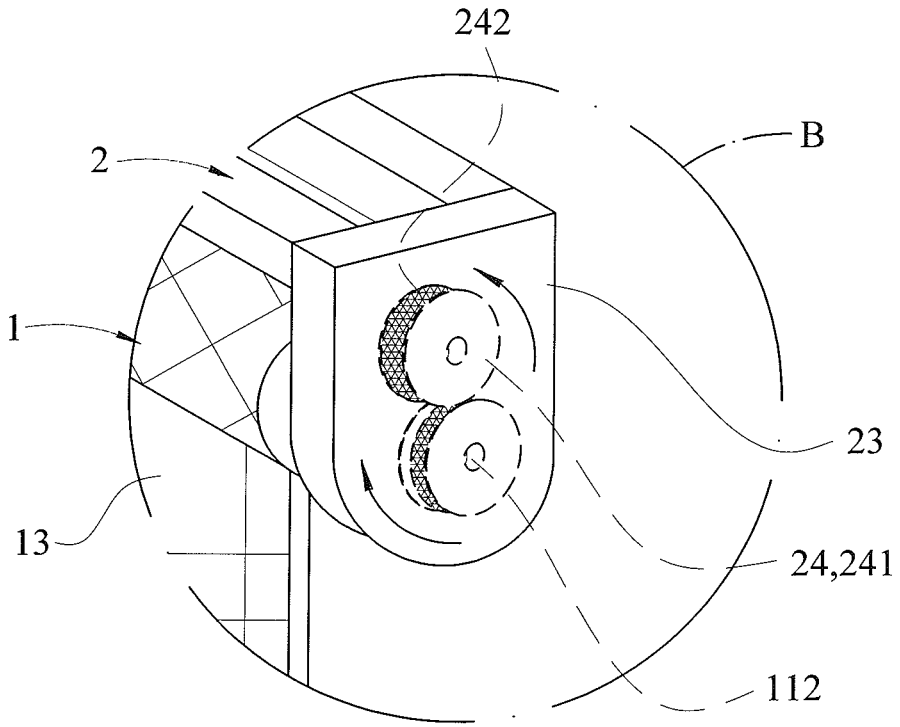
FIG. 7 is another amplified perspective view of a portion B of FIG. 4.
Figure 8:
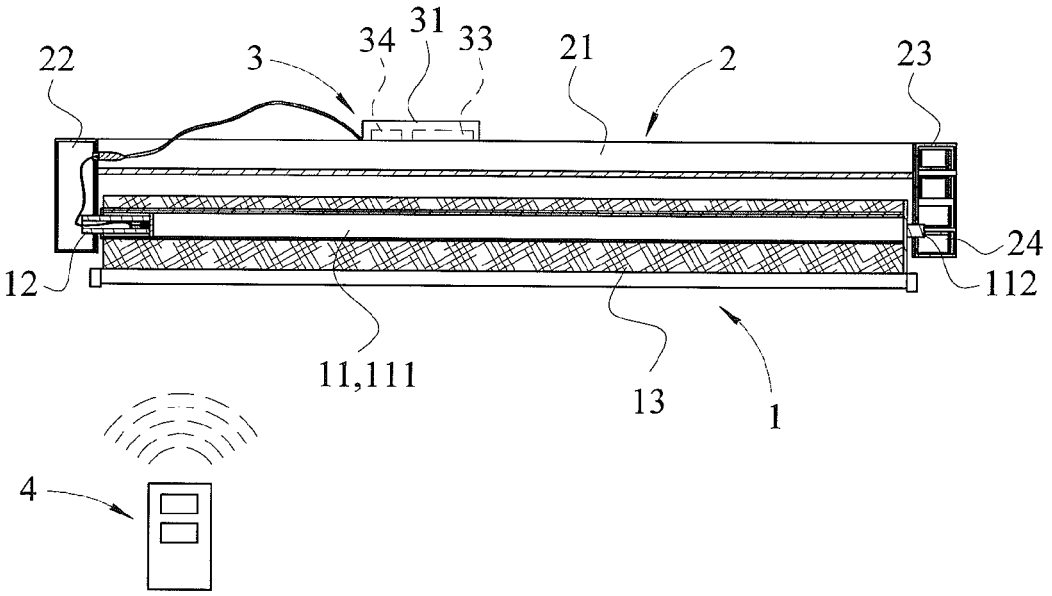
FIG. 8 is another cross sectional view showing the operation of the energy saving apparatus for the electric roller shutter in accordance with the preferred embodiment of the present innovation.

Referring to the drawings and initially to FIGS. 1-3, an energy saving apparatus for an electric roller shutter in accordance with a preferred embodiment of the present innovation comprises: a curtain unit 1, a fixing unit 2, a signal receiver 3, and a controller 4.

The curtain unit 1 includes a driving shaft 11, and the driving shaft 11 has a chamber 111 defined therein from a first end thereof and has a rotary connecting portion 112 formed on a second end thereof. The curtain unit 1 also includes a driver 12 disposed in the chamber 111 of the driving shaft 11 so as to drive the driving shaft 11 to rotate. In addition, the curtain unit 1 includes a curtain 13 fixed on the driving shaft 11 and rolls upwardly or unrolls downwardly as the driving shaft 11 rotates.

The fixing unit 2 is configured to fix the curtain unit 1 and includes a mounting rack 21; a first seat 22 mounted on a first end of the mounting rack 21 and configured to fix the driving shaft 11; a second seat 23 mounted on a second end of the mounting rack 21 and configured to fix the rotary connecting portion 112 of the driving shaft 11; and a rolling assembly 24 secured in the second seat 23 and rotatably connecting with the rotary connecting portion 112 of the driving shaft 11, wherein the rolling assembly 24 reduces power consumption of the driver 12 and facilitates an upward rolling of the curtain 13 of the curtain unit 1, when the curtain 13 of the curtain unit 1 rolls upwardly.

The signal receiver 3 is electrically connected with the driver 12 of the curtain unit 1 and includes a casing 31; a coupling portion 32 disposed on one end of the casing 31 and electrically coupling with the driver 12 of the curtain unit 1; a power supply module 33 housed in the casing 31 and configured to supply power to the driver 12; and a receiving module 34 accommodated in the casing 31.

The controller 4 is configured to send a signal to the receiving module 34 in the casing 31 of the signal receiver 3, such that the driver 12 of the curtain unit 1 is controlled by the controller 4 to operate.

The mounting rack 21 of the fixing unit 2 has an accommodating groove 211 for housing the first seat 22 and the second seat 23, wherein the first seat 22 has a first covering part 221 and a first lid 222 connecting with the first covering part 221, and the first lid 222 has at least one first locking segment 2221 extending outwardly from a top thereof and configured to retain with the accommodating groove 211 of the mounting rack 21. The first lid 222 also has a first orifice 2222 for coupling with the driver 12 of the driving shaft 11, and the first lid 222 further has a second orifice 2223 defined thereon. The second seat 23 has a second covering part 231 and a second lid 232 connecting with the second covering part 231, wherein the second covering part 231 has a plurality of posts 2311 for positioning the rolling assembly 24, and the second lid 232 has at least one second locking segment 2321 extending outwardly from a top thereof and configured to retain with the accommodating groove 211 of the mounting rack 21. The second lid 232 also has a first aperture 2322 for coupling with the driving shaft 11 of the curtain unit 1, and the rotary connecting portion 112 of the driving shaft 11 rotatably connects with the rolling assembly 24.

The first covering part 221 of the first seat 22 has a plurality of first recesses 2211 defined therein, and the first lid 222 of the first seat 22 has a plurality of first insertions 2224, wherein each first insertion 2224 is inserted into each of the plurality of first recesses 2211. The second covering part 231 of the second seat 23 has a plurality of second recesses 2312 defined therein, and the second lid 232 of the second seat 23 has a plurality of second insertions 2323, wherein each second insertion 2323 is inserted into each of the plurality of second recesses 2312.

The driver 12 has a transmission member 121, and the transmission member 121 has a first positioning disc 1211 fixed on a first end thereof and has a connection hole 1212 formed on a second end thereof. The driver 12 also has a drive motor 122 connected with the connection hole 1212 of the transmission member 121, and the drive motor 122 has a second positioning disc 1221 arranged on one end thereof, the second positioning disc 1221 has a plurality of notches 1222 defined on a peripheral side thereof. Furthermore, the driver 12 has an affix protrusion 123 extending outwardly from the first positioning disc 1211 of the transmission member 121; a wire 124 coupled with the drive motor 122 and extending through the transmission member 121 and the affix protrusion 123, wherein the wire 124 has a connector 1241 disposed in the second orifice 2223 of the first lid 222 of the first seat 22, and the connector 1241 is electrically connected with the coupling portion 32 of the signal receiver 3, hence when the driver 12 is mounted in the chamber 111 of the driving shaft 11 of the curtain unit 1, the first positioning disc 1211 of the transmission member 121 of the driver 12 and the second positioning disc 1221 of the drive motor 122 are housed in the chamber 111. When the drive motor 122 operates, it drives the second positioning disc 1221 and the first positioning disc 1211 of the transmission member 121 to rotate so that the driving shaft 11 of the curtain unit 1 is driven to revolve by the second positioning disc 1221 and the first positioning disc 1211. Preferably, the drive motor 122 of the driver 12 is a DC motor, and a DC voltage of the DC motor is less than 12 V, wherein the DC voltage is 4.5 V.

To fix the driver 12 in the chamber 111 of the driving shaft 11 of the curtain unit 1, the chamber 111 includes a plurality of locating ribs 1111 retained in the plurality of notches 1222 of the second positioning disc 1221 of the drive motor 122.

The rolling assembly 24 has two rotating discs 241, and each rotating disc 241 has an opening 2411 for connecting with each of the plurality of posts 2311. The rolling assembly 24 also has a reed 242 surrounding around the two rotating discs 241.

Referring to FIGS. 4 to 8, when the driver 12 is mounted in the chamber 111 of the driving shaft 11 of the curtain unit 1, the first positioning disc 1211 of the transmission member 121 of the driver 12 and the second positioning disc 1221 of the drive motor 122 are housed in the chamber 111, wherein the first positioning disc 1211 of the transmission member 121 retains the driving shaft 11 of the curtain unit 1, and when the drive motor 122 operates, it drives the second positioning disc 1221 of the drive motor 122 and the first positioning disc 1211 of the transmission member 121 to rotate so that the driving shaft 11 of the curtain unit 1 is driven by the second positioning disc 1221 and the first positioning disc 1211 to revolve. When the energy saving apparatus of the present invention is hung or abuts against a door or a peripheral side of a window frame, a button on the controller 4 is pressed to send the signal to the receiving module 34 in the casing 31 of the signal receiver 3, such that the driver 12 of the curtain unit 1 is controlled by the controller 4 to operate, wherein the rolling assembly 24 facilitate the upward rolling of the curtain 13 of the curtain unit 1. When the curtain 13 of the curtain unit 1 rolls upwardly, the reed 242 drives the curtain 13 to roll upwardly, thus reducing power consumption of the driver 12 of the curtain unit 1.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An energy saving apparatus for an electric roller shutter, comprising:

a curtain unit including a driving shaft, and the driving shaft having a chamber defined therein from a first end thereof and a rotary connecting portion formed on a second end thereof; a driver disposed in the chamber of the driving shaft so as to drive the driving shaft; and a curtain fixed on the driving shaft and rolling upwardly or unrolling downwardly as the driving shaft rotates;

a fixing unit configured to fix the curtain unit and including a mounting rack; a first seat mounted on a first end of the mounting rack and configured to fix the driving shaft of the curtain unit; a second seat mounted on a second end of the mounting rack and configured to fix the rotary connecting portion of the driving shaft; and a rolling assembly secured in the second seat and rotatably connecting with the rotary connecting portion of the driving shaft, wherein the rolling assembly has two rotating discs, and each rotating disc has an opening for connecting with each of a plurality of posts of a second covering part of the second seat, and the rolling assembly also has a reed surrounding around the two rotating discs;

a signal receiver electrically connected with the driver of the curtain unit and including a casing; a coupling portion disposed on one end of the casing and electrically coupling with the driver of the curtain unit; a power supply module housed in the casing and configured to supply power to the driver; and a receiving module accommodated in the casing; and a controller configured to send a signal to the receiving module in the casing of the signal receiver, such that the driver of the curtain unit is controlled by the controller to operate;

wherein the mounting rack of the fixing unit has an accommodating groove for housing the first seat and the second seat;

wherein the first seat has a first covering part and a first lid connecting with the first covering part, and the first lid has at least one first locking segment extending outwardly from a top of the first lid and configured to retain in the accommodating groove of the mounting rack; the first lid also has a first orifice for coupling with the driver of the driving shaft, and the first lid further has a second orifice defined thereon; the second seat has the second covering part and a second lid connected with the second covering part, wherein the second covering part has the plurality of posts for positioning the rolling assembly, and the second lid has at least one second locking segment extending outwardly from a top of the second lid and configured to retain in the accommodating groove of the mounting rack; and the second lid also has a first aperture for coupling with the driving shaft of the curtain unit, the rotary connecting portion of the driving shaft rotatably connects with the rolling assembly;

wherein the driver has a transmission member, and the transmission member has a first positioning disc fixed on a first end thereof and has a connection hole formed on a second end thereof; the driver also has a drive motor connected with the connection hole of the transmission member, and the drive motor has a second positioning disc arranged on one end thereof, the second positioning disc has a plurality of notches defined on a peripheral side thereof; the driver has an affix protrusion extending outwardly from the first positioning disc of the transmission member; a wire coupled with the drive motor and extending through the transmission member and the affix protrusion, wherein the wire has a connector disposed in the second orifice of the first lid of the first seat, and the connector is electrically connected with the coupling portion of the signal receiver, when the driver is mounted in the chamber of the driving shaft of the curtain unit, the first positioning disc of the transmission member of the driver and the second positioning disc of the drive motor are housed in the chamber, and when the drive motor operates, it drives the second positioning disc and the first positioning disc of the transmission member to rotate so that the driving shaft of the curtain unit is driven to revolve by the second positioning disc and the first positioning disc.

2. The energy saving apparatus for the electric roller shutter as claimed in claim 1, wherein the drive motor of the driver is a DC motor, and DC voltage of the DC motor is less than 12V.

3. The energy saving apparatus for the electric roller shutter as claimed in claim 1, wherein the chamber of the driving shaft includes a plurality of locating ribs retained in the plurality of notches of the second positioning disc of the drive motor.

4. The energy saving apparatus for the electric roller shutter as claimed in claim 1, wherein the first covering part of the first seat has a plurality of first recesses defined therein, and the first lid of the first seat has a plurality of first insertions, wherein each first insertion is inserted into each of the plurality of first recesses.

5. The energy saving apparatus for the electric roller shutter as claimed in claim 1, wherein the second covering part of the second seat has a plurality of second recesses defined therein, and the second lid of the second seat has a plurality of second insertions, wherein each second insertion is inserted into each of the plurality of second recesses.

* * * * *